US007523893B2

(12) United States Patent
Francis et al.

(10) Patent No.: US 7,523,893 B2
(45) Date of Patent: Apr. 28, 2009

(54) TRAIN DETECTION

(75) Inventors: Jonathan David Francis, Chippenham (GB); Paul Robertshaw, Hatfield (GB)

(73) Assignee: Westinghouse Brake and Signal Holdings Limited, Wiltshire (GB)

( * ) Notice: Subject to any disclaimer, the term of this patent is extended or adjusted under 35 U.S.C. 154(b) by 403 days.

(21) Appl. No.: 11/222,917

(22) Filed: Sep. 8, 2005

(65) Prior Publication Data

US 2006/0060724 A1 Mar. 23, 2006

(30) Foreign Application Priority Data

Sep. 9, 2004 (GB) ..... 0419995.6

(51) Int. Cl.
*B61L 23/00* (2006.01)

(52) U.S. Cl. ..... 246/34 A; 246/246; 246/253; 246/122 R; 246/255; 246/270 R

(58) Field of Classification Search ..... 246/297, 246/359, 37, 34 A, 251, 256, 246, 249, 253, 246/255, 270 R, 292, 293, 300, 365, 368, 246/369; 324/713, 217
See application file for complete search history.

(56) References Cited

U.S. PATENT DOCUMENTS 2,104,591 A * 1/1938 Martin ..... 246/41
3,663,809 A 5/1972 Sibley
3,702,396 A 11/1972 Paulve
4,932,614 A 6/1990 Birkin

FOREIGN PATENT DOCUMENTS

| | | |
|---|---|---|
| CA | 1288853 | 9/1991 |
| DE | 3634696 A1 | 10/1986 |
| DE | 3738696 A1 | 11/1987 |
| EP | 217297 A3 | 4/1987 |
| GB | 0001578 A | 2/1915 |
| GB | 363405 A | 12/1931 |

OTHER PUBLICATIONS

Article entitled *Modern Railway Signalling* by M.G. Tweedie and T.S. Lascelles, Blackie & Son Ltd., First Issued 1925, (7 pages) cover page & pp. 126, 234-237.
European Search Report conducted Nov. 30, 2005 for corresponding European Application No. EP05076928, 1 pg.
United Kingdom Search Report conducted Jan. 7, 2005 for corresponding United Kingdom Application No. GB0419995.6, 1 pg.

* cited by examiner

*Primary Examiner*—Mark T Le
(74) *Attorney, Agent, or Firm*—Christie, Parker & Hale, LLP

(57) ABSTRACT

A train detection mechanism for detecting the presence of a train on a section of track, the track section including first and second rails 1, 2 and delimited by first and second ends thereof, includes current injector for injecting current into the first rail at the first end of the section and current receiver for receiving current from the second rail at the first end of the section, and a shunt 3 connected between the first and second rails at the second end of the section, characterized in that the shunt includes a switch 4 for controlling current flow through the shunt, the switch being operable by the passage of a train.

18 Claims, 2 Drawing Sheets

TRAIN DETECTION

CROSS-REFERENCE TO RELATED APPLICATION(S)

This application claims the benefit of and incorporates by reference the entire disclosure of United Kingdom Application No. 0419995.6, filed Sep. 9, 2004 pursuant to 35 U.S.C. § 119(a-d).

BACKGROUND OF THE INVENTION

This invention concerns a train detection mechanism and method for detecting the presence of a train on a section of track.

It is common to determine the presence of a train on a section of track by using a track circuit. Conventionally the track circuits may be arranged in two fundamental ways, those where the transmitter and receiver are located at different positions within the track circuit and those where the transmitter and receiver are co-incident at one end of the track circuit. With the co-incident method, current is injected into one of the rails. Normally, i.e. in the absence of a train, the current will flow along the rail, pass through a shunt provided to connect the rails and then return back along the second rail. The shunt device presents a low impedance to the current and may consist of a simple wire bond between the rails where no other a.c. or d.c. is present on the rails. A narrow band shunt is used where a.c. is present and a wide band shunt is used where non-coded d.c. is present. The current across both rails may thus be measured, and hence the impedance of the circuit. If a train is present in the track section, the current may pass from one rail to the other through the wheels and an axle of the train. As the train passes along the track section, the length of the circuit will change, and the impedance of the circuit will also correspondingly change. By measuring this change in impedance, it is therefore possible to determine not just that a train is present on the track section, but also the speed and hence position of the train within the section.

Track circuits such as these may be used anywhere in a rail system. For example, a pair of track circuits may be used to determine the presence of a train in the run-up to a level crossing, i.e. one track circuit is used on each side of the level crossing, to detect trains approaching from either direction, to cater for single lines and bi-directional traffic. Such an arrangement is shown in FIG. 1, where a track circuit is shown on each side of a central level crossing island. In this instance the audio frequency current is injected and subsequently received by a transmitter/receiver module in a Grade Crossing Predictor (GCP) via a termination shunt. The GCP is a microprocessor-controlled device that provides activation of the crossing protection equipment, such as warning lights and barriers, by sensing the approach of a train. The GCP is located at the crossing whilst the termination shunt is fitted across the rails at a suitable distance from the crossing to define the limit of the track circuit. This limit is chosen to provide sufficient warning time for the fastest train that may be encountered. The GCP applies a constant current a.c. signal to the track and measures the level of the resulting voltage.

As a train approaches the crossing, the impedance of the track circuit changes once the train passes over the shunt, and continues to change as the train moves closer. This change of impedance is constantly monitored by the GCP via voltage variation and, by calculating the rate of change, the speed of the train is determined. From this speed, the moment at which the crossing needs to be activated is determined and the warning is given and the road closed to traffic accordingly. By this means, a constant warning time can be achieved regardless of the variety of train speeds that may be encountered.

However, detection of the train relies upon achieving a wheel to rail interface of sufficiently low resistance to effect a path for the track circuit current. Conditions of rail head contamination, or the light weight of some vehicles can result in a wheel to rail interface that is of too high a resistance to achieve activation.

SUMMARY OF THE INVENTION

It is an object of the present invention to provide a train detection mechanism which improves upon known track circuits by providing a diverse back-up mode of operation.

In accordance with a first aspect of the present invention there is provided a train detection mechanism for detecting the presence of a train on a section of track, the track section comprising first and second rails and delimited by first and second ends thereof, the mechanism comprising current injection means for injecting current into the first rail at the first end of the section and means for receiving current from the second rail at the first end of the section, and a shunt connected between the first and second rails at the second end of the section, characterised in that the shunt comprises a switch for controlling current flow through said shunt, said switch being operable by the passage of a train.

Preferably, impedance measuring means are connected to the first ends of the first and second rails.

In use, the switch is preferably closed in the absence of the passage of a train, so that the current may flow from the current injection means, along the first rail, through the shunt to the second rail and the means for receiving current, thus creating a circuit. The switch may then be opened by the passage of a train onto the section of track, so that the circuit is opened.

In a first mode of operation, occurring when a train is present on the section of track, a second circuit may be formed comprising the first and second rails and an axle of the train. The location of the train may be determined by measuring the change of impedance of the second circuit as the train moves along the track section.

In a second mode of operation, the presence of a train on the track section may be determined by an increase in the impedance measured by the impedance measuring means, caused by the opening of the circuit.

Preferably, the switch comprises a treadle.

Advantageously, the switch is returned to a closed position after the passage of the train.

The injected current may be at audio frequency.

According to a second aspect of the present invention, there is provided a track section comprising the train detection mechanism.

According to a third aspect of the present invention, there is provided a track circuit comprising the train detection mechanism.

According to a fourth aspect of the present invention, there is provided a level crossing comprising the train detection mechanism.

According to a fifth aspect of the present invention, there is provided a method of detecting the presence of a train on a section of track, the track section comprising first and second rails, comprising the steps of:

a) providing a shunt connected between the first and second rails at an end of the section, the shunt comprising a switch for controlling current flow through said shunt, said switch being operable by the passage of a train;

b) injecting current into a rail and receiving said current from the other rail;

c) measuring the impedance experienced by the current.

The switch is preferably kept closed in the absence of the passage of a train and opened by the passage of a train. An opening of the switch causes cessation of current flow provided the axles do not shunt and a rise in the measured impedance, hence indicating the presence of a train in the track section.

Advantageously, the movement of a train within the track section causes a change in the measured impedance. Preferably, the method includes the step of determining the location of the train by measuring the impedance change.

Preferably, the switch comprises a treadle.

Advantageously, step b) involves injecting current of audio frequency.

BRIEF DESCRIPTION OF THE DRAWINGS

The invention will now be described by way of example with reference to the following figures, in which.

DETAILED DESCRIPTION OF THE INVENTION

Figure 1:
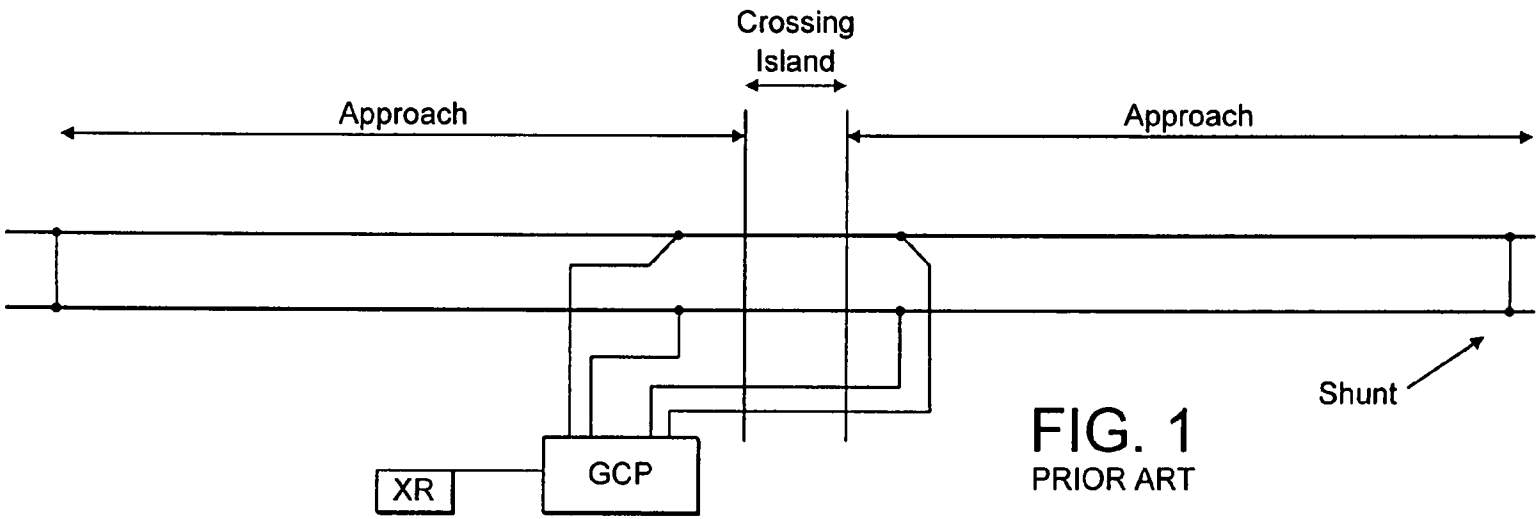
FIG. 1 PRIOR ART
FIG. 1 shows a prior art level crossing system using conventional track circuits of the co-incident transmitter and receiver type.
Figure 2:
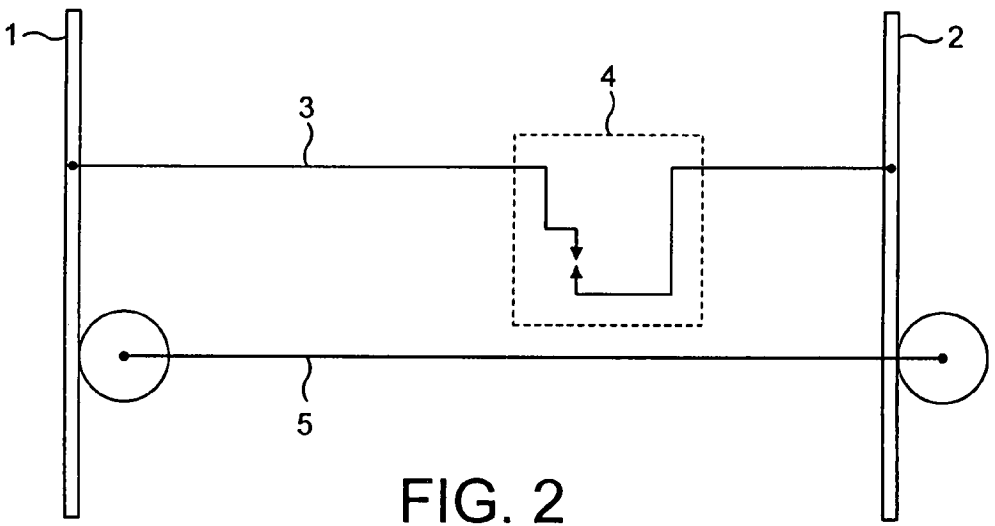
FIG. 2 shows a schematic diagram of a shunt arrangement for a train detection mechanism according to the present invention.
Figure 3:
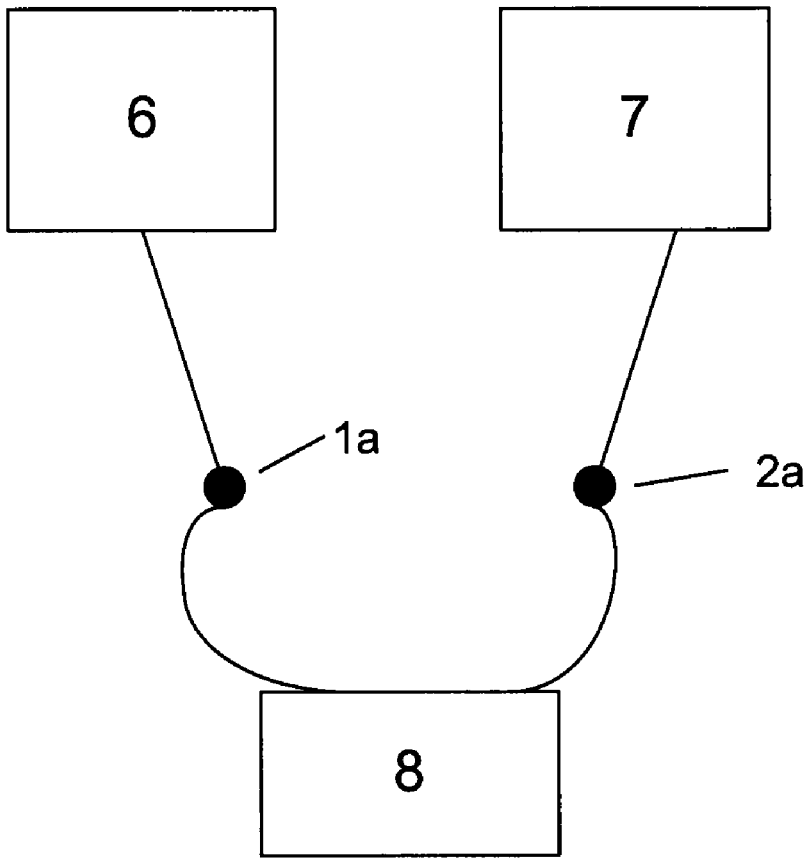
FIG. 3 shows a schematic diagram of a relationship between various components and rail ends.

With reference now to FIG. 2, a shunt arrangement is shown for a train detection mechanism in accordance with the present invention, and to FIG. 3, which shows a relationship between various components including current injection means 6, current receiving means 7 and impedance measuring means 8, and the first ends 1*a*,2*a* of rails 1,2, respectively. FIG. 2 shows a portion of first and second rails 1 and 2 in the vicinity of the distal end of the track circuit from the current injection means 6. The rails 1, 2 are electrically connected by a termination shunt 3. In an advance on the prior art, the shunt 3 includes a switch 4, such as a treadle, connected in series with the shunt 3. The switch 4 is normally closed in its default state in the absence of the passage of the train. When the switch is closed, current can flow from the injection means, along rail 1, through shunt 3 and back along rail 2 to current receiving means 7. Of course, the current used will usually be a.c. and so in operation the current direction will change. In this state, impedance measuring means 8 in a GOP for example connected to the track circuit will measure a substantially constant voltage, and hence impedance, dependent primarily on the length of the circuit.

Now consider the effect of a passage of a train onto the track circuit. As the train passes the termination shunt 3, a wheel axle 5 enters the track circuit. If there is a sufficiently good contact between the wheels and the rails 1, 2, then current will be able to flow from one rail, through a wheel, along the axle 5, and to the other rail via the other wheel. In other words, the train's wheels and axle will act as a shunt, and a current will be able to flow through a different circuit comprising the rails and that axle shunt. Note that current will flow through this circuit whether switch 4 is open or closed. In this case, the impedance measured by the impedance measuring means will change dependent on the position of the train, and as the train approaches the impedance measuring means, the circuit will shorten and the impedance will reduce accordingly. It will therefore be possible to determine the speed of the train, and hence its position on the circuit, in an identical way to that described with reference to the prior art.

As described earlier, it is not always possible to achieve good electrical contact between the wheels and the rails, for example if the train is not heavy enough to force sufficient contact between them, or if there is contamination of the rail head. However, the inventive apparatus still enables the presence of a train in the track circuit to be detected.

When the train passes over the termination shunt 3 onto the track circuit, treadle 4 is opened, for example by activation of the treadle arm by the wheels of the train, stopping the flow of current through shunt 3 and creating an open circuit. As mentioned earlier, if the wheels of the train make sufficiently good electrical contact with the rails, then the open circuit will be masked as current may still flow through the axle shunt so the open circuit condition is not detected and the train may be detected as described previously. However, if there is insufficient contact, then current will be unable to flow due to the open switch, and the impedance measuring means will correspondingly detect a high impedance. This high impedance value will be detected as a fault state, for example by the GCP, in the same manner as if the termination shunt 3 had been removed or had gone open circuit through damage or fault. Detection of this state will result in activation of warning devices. For example, if the track circuit was positioned in the approach to a level crossing, then detection of the fault state would result in or cause warning devices at the crossing to be activated.

Following passage of the train, the treadle will return to its unactivated state, which will reconnect the termination shunt 3 across the running rails 1, 2 to re-establish the limit of the track circuit. If this is used at a level crossing, this will occur before the train reaches the crossing.

A directionally-discriminating treadle 4 may be employed so that the open circuit situation can only be produced by a train travelling in one direction, for example approaching the crossing, and not by one departing the crossing. A suitable treadle would be the well-known "Forfex" type which includes two arm contacts. A wheel passing the treadle will contact each arm in turn, so that the direction of the train can be determined.

The GCP is designed to respond to a number of conditions in such a way as to activate the warning. These conditions relate to fault situations and predetermined events that may compromise the ability of the GCP to detect an approaching train. With the present invention, the predetermined event of high impedance detection is extended to provide diverse activation of the warning.

Although the invention has been described with reference to the embodiments above, there are many other modifications and alternatives possible within the scope of the claims. For example, any switch may be used that is activated by the passage of a train. The invention is not limited to level crossing applications, but may be used to detect the presence of a train in any section of track.

What is claimed is:

1. A train detection mechanism for detecting the presence of a train on a section of track, the track section comprising first and second rails and delimited by first and second ends thereof, the mechanism comprising current injector for injecting current into the first rail at the first end of the section and current receiver for receiving current from the second rail at the first end of the section, and a shunt connected between the first and second rails at the second end of the section, characterized in that the shunt comprises a switch for controlling current flow through said shunt, said switch being operable physically by the passage of a train, wherein the switch comprises a treadle positioned in series with the shunt, and wherein switching of the treadle to an open state is physically operated by the passage of the train and prevents current flow through the shunt.

2. A mechanism according to claim 1, comprising impedance measuring device connected to the first ends of the first and second rails.

3. A mechanism according to claim 2, wherein in use the switch is closed in the absence of the passage of a train, so that the current may flow from the current injector, along the first rail, through the shunt to the second rail and the current receiver for receiving current, thus creating a circuit.

4. A mechanism according to claim 3, wherein in use, the switch is opened by the passage of a train onto the section of track, so that the circuit is opened.

5. A mechanism according to claim 4, wherein in a first mode of operation, occurring when a train is present on the section of track, a second circuit is formed comprising the first and second rails and an axle of the train.

6. A mechanism according to claim 5, wherein in the first mode of operation, the location of the train may be determined by measuring the change of impedance of the second circuit as the train moves along the track section.

7. A mechanism according to claim 4, wherein in a second mode of operation, the presence of a train on the track section is determined by an increase in the impedance measured by the impedance measuring device, caused by the opening of the circuit.

8. A mechanism according to claim 1, wherein the switch is returned to a closed position after the passage of the train.

9. A mechanism according to claim 1, wherein the injected current is at audio frequency.

10. A track section comprising the train detection mechanism according to claim 1.

11. A track circuit comprising the train detection mechanism according to claim 1.

12. A level crossing comprising the train detection mechanism according to claim 1.

13. A method of detecting the presence of a train on a section of track, the track section comprising first and second rails, comprising the steps of:

a) providing a shunt connected between the first and second rails at an end of the section, the shunt comprising a switch for controlling current flow through said shunt, said switch being operable physically by the passage of a train, wherein the switch comprises a treadle positioned in series with the shunt, and wherein switching of the treadle to an open state is physically operated by the passage of the train and prevents current flow through the shunt;

b) injecting current into a rail and receiving said current from the other rail;

c) measuring the impedance experienced by the current.

14. A method according to claim 13, wherein the switch is kept closed in the absence of the passage of a train, and opened by die passage of a train.

15. A method according to claim 14, wherein an opening of the switch causes a rise in the measured impedance, hence indicating the presence of a train in the track section.

16. A method according to claim 13, wherein the movement of a train within the track section causes a change in the measured impedance.

17. A method according to claim 16, including the step of determining the location of the train by measuring the impedance change.

18. A method according to claim 13, wherein step b) involves injecting current of audio frequency.

* * * * *

UNITED STATES PATENT AND TRADEMARK OFFICE

CERTIFICATE OF CORRECTION

PATENT NO. : 7,523,893 B2
APPLICATION NO. : 11/222917
DATED : April 28, 2009
INVENTOR(S) : Jonathan D. Francis et al.

It is certified that error appears in the above-identified patent and that said Letters Patent is hereby corrected as shown below:

In the Claims

| | |
|---|---|
| Column 5, Claim 2, line 6 | After "comprising"<br>Insert -- an -- |
| Column 6, Claim 14, line 22 | Delete "die"<br>Insert -- the -- |

Signed and Sealed this

Second Day of November, 2010

David J. Kappos

David J. Kappos
*Director of the United States Patent and Trademark Office*